US006216890B1

(12) United States Patent
Rathmer

(10) Patent No.: US 6,216,890 B1
(45) Date of Patent: Apr. 17, 2001

(54) DISPLAY FOR FLAT OBJECT LIKE FLOOR TILE AND CEILING TILE

(76) Inventor: Heinz Rathmer, Rosenthal 123, D-48683 Ahaus (DE)

( * ) Notice: Subject to any disclaimer, the term of this patent is extended or adjusted under 35 U.S.C. 154(b) by 0 days.

(21) Appl. No.: 09/247,473

(22) Filed: Feb. 8, 1999

(30) Foreign Application Priority Data

Feb. 11, 1998 (DE) ..... 198 05 420

(51) Int. Cl.[7] ..... B65G 1/10; A47F 3/08

(52) U.S. Cl. ..... 211/175; 211/1.57; 414/280

(58) Field of Search ..... 211/1.51, 1.57, 211/175, 187; 414/268, 269, 277, 280–282

(56) References Cited

U.S. PATENT DOCUMENTS

| | | | | |
|---|---|---|---|---|
| 3,883,008 | * | 5/1975 | Castaldi | 414/270 |
| 4,076,132 | * | 2/1978 | Thompson et al. | 414/269 |
| 4,636,634 | * | 1/1987 | Harper et al. | 414/730 |
| 4,772,176 | * | 9/1988 | Montgomery | 211/1.51 |
| 4,912,575 | * | 3/1990 | Shiosaki | 414/280 X |
| 5,032,053 | * | 7/1991 | Krieg | 414/278 |
| 5,118,240 | * | 6/1992 | Kyoo | 414/269 |
| 5,139,384 | * | 8/1992 | Tuttobene | 414/281 |
| 5,174,707 | * | 12/1992 | Suekane et al. | 414/269 |
| 5,208,753 | * | 5/1993 | Acuff | 414/612 |
| 5,211,296 | * | 5/1993 | D'Heygere | 211/1.51 |
| 5,328,316 | * | 7/1994 | Hoffmann | 414/280 |
| 5,330,062 | * | 7/1994 | Murphree | 211/1.51 |
| 5,333,982 | * | 8/1994 | Tanizawa et al. | 414/279 |
| 5,380,139 | * | 1/1995 | Pohjonen et al. | 414/280 |
| 5,405,232 | * | 4/1995 | Lloyd et al. | 414/280 |
| 5,455,810 | * | 10/1995 | Luffel | 414/280 X |
| 5,490,752 | * | 2/1996 | Tokiwa et al. | 414/280 |
| 5,544,996 | * | 8/1996 | Castaldi et al. | 414/280 |
| 5,564,880 | * | 10/1996 | Lederer | 414/280 |
| 5,615,992 | * | 4/1997 | Proske et al. | 414/278 X |
| 5,636,750 | * | 6/1997 | Heyl | 211/1.51 |
| 5,690,464 | * | 11/1997 | Gagnon et al. | 414/278 X |
| 5,785,183 | * | 7/1998 | Rejete | 211/1.51 |
| 5,791,852 | * | 8/1998 | Bibby et al. | 414/278 |
| 5,810,540 | * | 9/1998 | Castaldi | 414/280 |

* cited by examiner

*Primary Examiner*—Daniel P. Stodola
*Assistant Examiner*—Jennifer E. Novosad
(74) *Attorney, Agent, or Firm*—Herbert Dubno

(57) ABSTRACT

A display for floor tiles, ceiling tiles and like flat objects whereby the objects are displaced on plates in tiers. A pair of columns on either side of a rectangular platform which can be raised and lowered along the columns and has a carriage engageable with the plates to draw them out onto the platform. The lighting can be varied to represent different times of the day and the columns are bridged by a wall on which indicia are imaged.

3 Claims, 7 Drawing Sheets

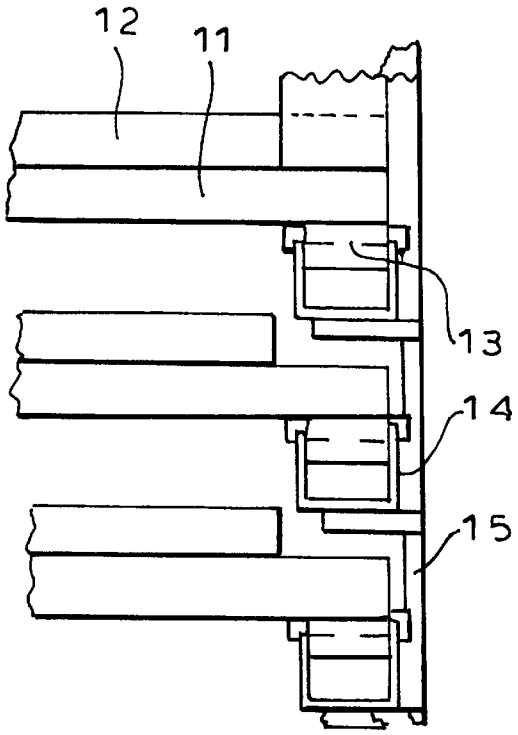
FIG. 4
FIG. 3
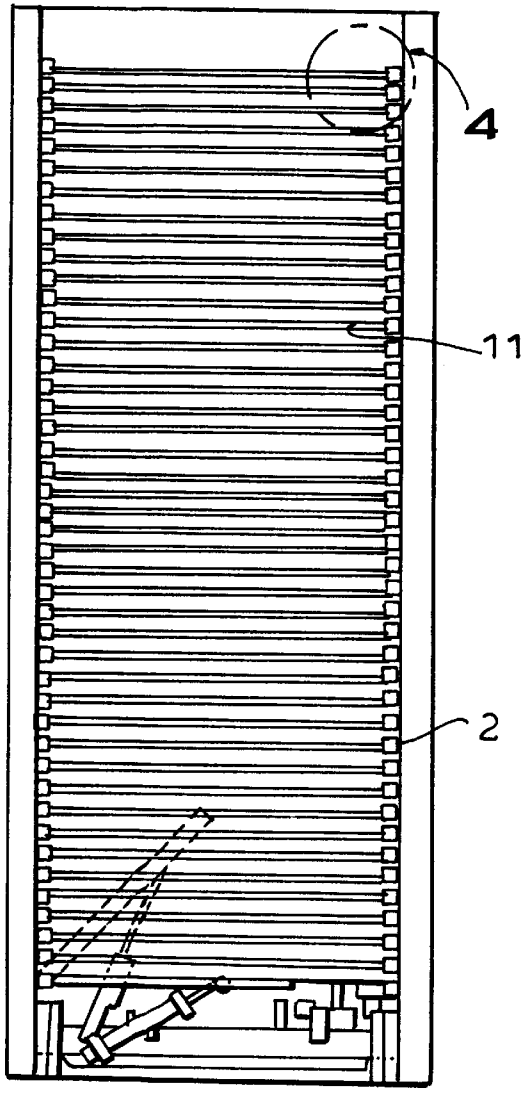

DISPLAY FOR FLAT OBJECT LIKE FLOOR TILE AND CEILING TILE

BACKGROUND OF THE INVENTION

The present invention is directed to a display for products, especially two-dimensional products, as for instance floor elements, tiles, etc.

FIELD OF THE INVENTION

For storing and presenting products it is known to store the same for instance in cupboards, stands, etc. which have drawers, plates etc. which can be drawn out. If the customer wishes to see a corresponding product, for instance, a drawer containing the product is drawn out so that the product can be looked at by the customer.

Furthermore, it is known to store such products on a plurality of plates which can be moved in a kind of lift from storing positions into corresponding presentation positions by a moving mechanism. In this manner a plurality of products can be stored in a relatively tight space, and the desired product can be transferred into the presentation position by the actuation of the moving mechanism. By this, the height of a room can be better used for the storing of such products, and only a relatively small space is required for the real presentation of the product.

Of course, such products can also be disposed in a single manner one beside the other on corresponding tables, stands etc. for the presentation purposes. However, this kind of presentation has the great disadvantage that a large display floor area is required.

On the one side, the known presentation means require much space if they are to enable a comfortable and attractive presentation of the products, as is for instance the case with presentation tables stands etc., when they provide a relatively space-saving storage of the products, however, they have disadvantages with regard to the presentation of the products since there is little space for presentation and only an uncomfortable or less attractive presentation is possible for the customer.

OBJECT OF THE INVENTION

The object of the present invention is to provide a simply designed presentation unit of the cited kind which enables an especially space-saving storage and an especially attractive presentation of the products.

SUMMARY OF THE INVENTION

According to the invention this problem is solved by a presentation means for products, especially two-dimensional products, as for instance floor elements, tiles etc., said presentation means comprising at least one stand having a plurality of supporting plates for storing the products to be presented in different heights, said supporting plates being positioned one above the other and horizontally movably, a platform adjacent to the stand and movable up and down, said platform having a means for catching a supporting plate and for moving the same onto/below the platform into a presentation position and back again into the stand, a drive means for carrying out the upward and downward movement of the platform, a drive means for the means for catching and moving the supporting plate and a manually operable control means for the drive means.

On the one hand, the inventive solution assures an especially space-saving storage of the products on a plurality of supporting plates in the stand provided herefor. On the other hand, it enables an especially attractive presentation of the products by means of the platform which is provided adjacent to the stand and which is movable up and down, i.e. from a presentation position for the products into a position in which it can receive a supporting plate for a certain selected product. The platform has a means with which the selected supporting plate situated in the stand is caught if the platform is in the corresponding position of reception. After having caught the supporting plate the means moves the same into a presentation position onto or below the platform, whereafter, if possible, a lowering or lifting of the platform is carried out in order to bring the selected product with the supporting plate to a height suitable for the observation by the customer.

Furthermore, the inventive presentation means has a manually operable control means for the drive means of the platform and for the drive means of the means for catching and moving the supporting plate. Accordingly, the customer can select a certain product within the stand through a certain characterizing code, for instance, and can set in operation the drive means through the input of a corresponding control command by means of the control means. By this, the platform is moved into the corresponding position of reception for the supporting plate of the selected product, whereafter the drive means of the means for catching and moving the supporting plate is operated. Then, the supporting plate is removed from the stand and is moved onto/below the platform, whereafter the same, if necessary, is lowered or lifted into the position of presentation.

Accordingly, the inventive means enables an especially attractive form of presentation of the product which can be moved by the customer himself into a position in which he can not only see but also touch the product. The platform can be even moved into a position in which the customer can set his foot on. This is of especial importance for two-dimensional products, as floor elements, tiles etc. In spite of this form of presentation which is very favorable for the customer the concept of storing a plurality of products in closest space is not left. Moreover, the means can be handled in a simple manner, i.e. the customer himself can ask for the desired products from the storing stand, can transfer the desired products into the position of presentation and can transfer the same back into the stand.

An especially preferred embodiment of the invention is characterized by the feature that the presentation means includes two stands and that the platform is disposed between the two stands. Here it is possible to dispose products from both stands on the platform in a corresponding position of presentation through corresponding supporting plates. Accordingly, in this embodiment the platform has either two means for catching and moving supporting plates from the two stands or a single means which is provided with two elements for catching a respective supporting plate from a respective stand.

Another preferred embodiment of the invention is characterized by the feature that the platform is additionally pivotable. By this embodiment the products to be presented can not only be presented in a horizontal position but also in an inclined position or a vertical position. Of course, a corresponding drive means causing the pivoting process is controllable by means of the provided control means. Preferably, the platform is pivoted about a fictitious axis which extends parallel with regard to the front side of the stand or of the stands. Of course, according to this embodiment the supporting plates are arrested on the platform in a suitable manner in order to prevent that they slide off the platform during the pivoting process.

The platform is appropriately divided into an underframe and a cover plate wherein at least one actuating cylinder for pivoting the cover plate is provided between the underframe and the cover plate. Then, the extending and withdrawing of the piston-rod of the at least one actuating cylinder is controlled by means of the control means.

The means for catching and moving the supporting plate is preferably formed as carriage disposed at or in the platform. This carriage has at least one gripping member with which the supporting plate in the stand can be caught. By the movement of the carriage in the plane of the platform the supporting plate with the product is removed from the stand and is positioned onto the platform in the presentation position. By movement in reverse direction the carriage transfers the supporting plate back again into the corresponding compartment of the stand. The gripping means is removed from the supporting plate, and the carriage moves back again into its initial position in which the platform can be moved up and down for searching another supporting plate.

The supporting plates are preferably movabley supported by means of rollers in/on rails or tracks of the stand.

Corresponding rails or tracks are preferably also provided on the platform so that the supporting plate can be moved from its position in this stand into its position on the platform and back again without any problems.

As mentioned above, the means for catching and moving the supporting plate is formed as carriage which is disposed at or in the platform. Preferably, the carriage is movable along a track within the platform by means of a belt drive disposed in the platform. The belt drive is preferably disposed laterally from the carriage or from the carriage track. If the presentation means has two oppositely arranged stands, two carriages are provided which practically are moved by means of a common belt drive which is located between the two carriages in the platform. Preferably, the carriages are connected to the belt by means of clamping plates. The belt drive is preferably formed in such a manner that it has two pulleys located at the ends around which the belt extends in an endless manner. According to this embodiment the one carriage is connected to the upper belt portion and the other carriage is connected to the lower belt portion, for example by means of suitable clamping plates. Accordingly, when the belt drive is operated both carriages move into opposite directions so that both stands can be operated with a single belt drive.

The carriages themselves are preferably supported on rails by means of rollers in or at the platform.

Practically, the carriage has a catch provided with a recess for undergripping a catch member located at the supporting plate. In order to undergrip the catch member the catch or the carriage can carry out a corresponding horizontal stroke, for instance by means of a suitable actuating cylinder. Accordingly, the catch is moved in its open position into a position by means of the carriage in which it can grip around the catch member of the associated supporting plate. Thereafter, a horizontal movement of the catch into the position of engagement follows. Then, the carriage moves back on the platform until the supporting plate with the product fixed on the same reaches the presentation position. A transfer of the supporting plate back into the stand is realized in the reversed manner.

Accordingly, with such a system with two stands and two carriages within the platform there are tow carriage end positions in the lateral end portions of the platform and a central carriage position. The two end positions correspond to the positions in which the supporting plates disposed within the stands are caught by the catches while the central position corresponds to the presentation position. If one carriage is located in the central position the other carriage is located in the end position.

Preferably, the platform is movably suspended at the stand. If two stands are present it is movably suspended between the two stands. As means for suspending practically toothed belts are used at which the platform is fixed, preferably by means of clamping plates. In order to minimize the force necessary for lifting the platform the suspending system works practically with counter weights.

According to a further development the inventive presentation means has an image area above the platform. This area can serve for the mounting of still images or for the representation of moving images, i.e. in the last case can be formed, for instance, as screen or large image screen.

Furthermore, the presentation means has preferably an operating means with input means and display means. This can be, for instance, a control panel with keyboard and associated monitor. Through the input means the above-mentioned control means can be operated which, for instance, comprises a CPU with storage means. Accordingly, the customer can get suitable products from the stands by means of the operating means and can present the same on the platform. The corresponding presentation can be accompanied by a program shown on the image area or the monitor.

According to another preferred embodiment the presentation means has a lighting equipment directed to the platform. This lighting equipment is preferably variable in such a manner that different kinds of light (daylight, twilight etc.) can be represented herewith. Accordingly, the customer can observe the product disposed on the platform in the presentation position with different light.

BRIEF DESCRIPTION OF THE DRAWING

The above and other objects, features, and advantages will become more readily apparent from the following description, reference being made to the accompanying drawing in which:

FIG. 3 is a side view of a stand of the presentation means;

FIG. 4 is an enlarged representation of a part of FIG. 3;

SPECIFIC DESCRIPTION

Figure 1:
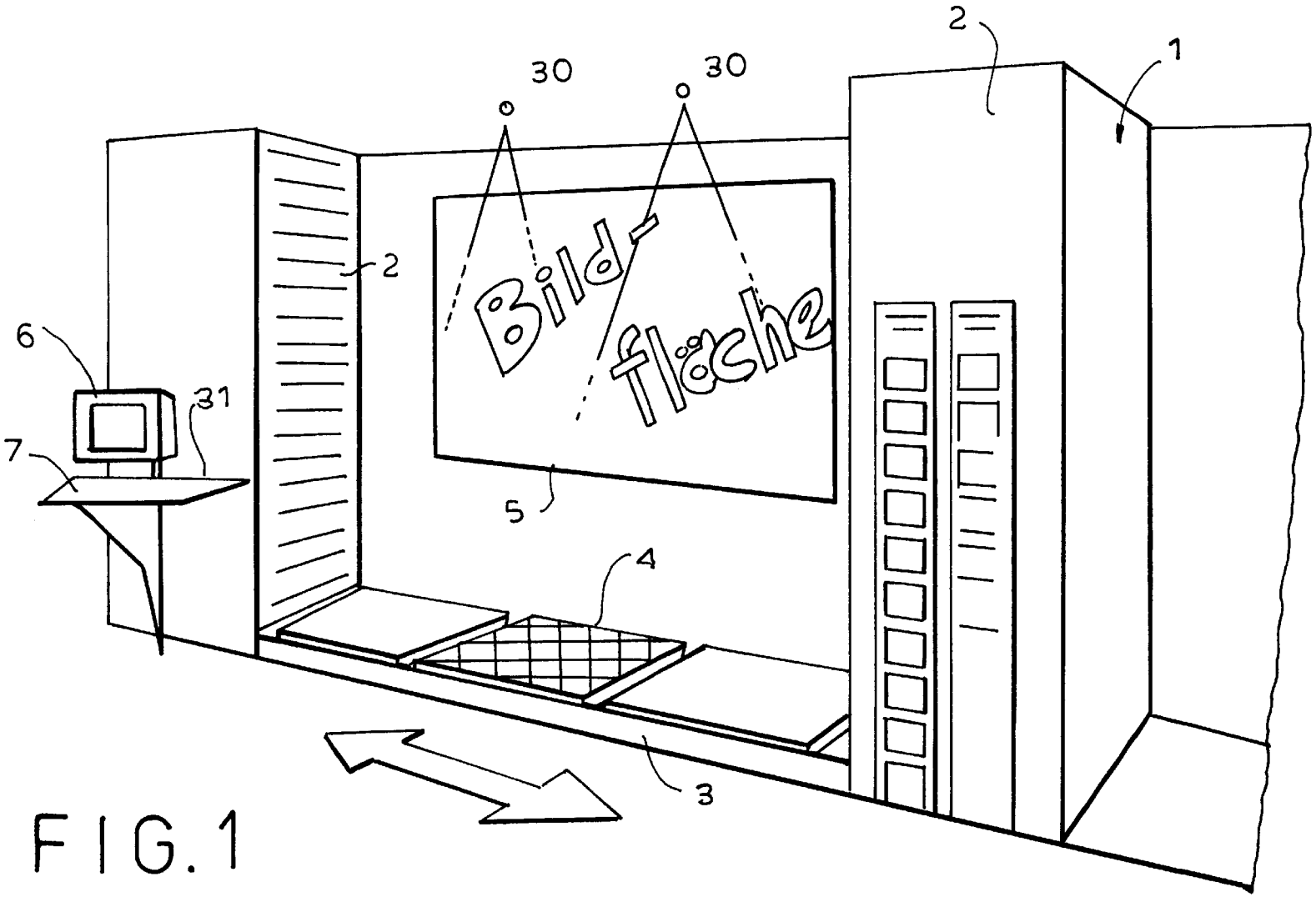
FIG. 1 is a perspective schematic representation of a presentation unit or display.

The presentation means 1 shown in FIG. 1 in a perspective view has two high stands 2 with an about square shape in cross-section which receive a plurality of superposed supporting plates, respectively, on which the products to be presented for purchasing purposes are disposed. In the present case these products are floor tiles 4.

An upwardly and downwardly movable platform 3 having a rectangular shape in the top view is disposed between the two strands 2. This platform is shown in FIG. 1 in its lowered position in which it can be entered by customers, for instance, in order to test the floor tiles 4 disposed thereon. Of course, this presentation means is not restricted to the presentation of floor tiles but can be also used for the presentation of other products, especially two-dimensional products.

An image area 5 which can be formed as large image screen, poster carrier area, projection screen etc. is arranged on the rear wall located between the two stands 2. This image area can be used for the presentation of the product to be purchased in an assisting manner. Furthermore, the presentation means includes an operating means 31 formed as control panel. An input keyboard 7 as well as the display means formed as monitor 6 are situated on the panel. The customer can control the presentation means 1 by means of the keyboard 7 so that the product desired by him can be caught from a stand 2 and stored on the platform 3. Then, the platform can be lifted or lowered in a suitable position. Simultaneously with the presentation of the product a program can be initiated which runs on the monitor 6 and/or the image area 5.

Furthermore, the customer can operate lighting equipment 30 directed to the platform 3. This lighting equipment is formed in such a variable manner that different day times can be simulated therewith, for instance sun light, twilight, darkness etc. Accordingly, the customer can see the presented product under different light relations.

Figure 2:
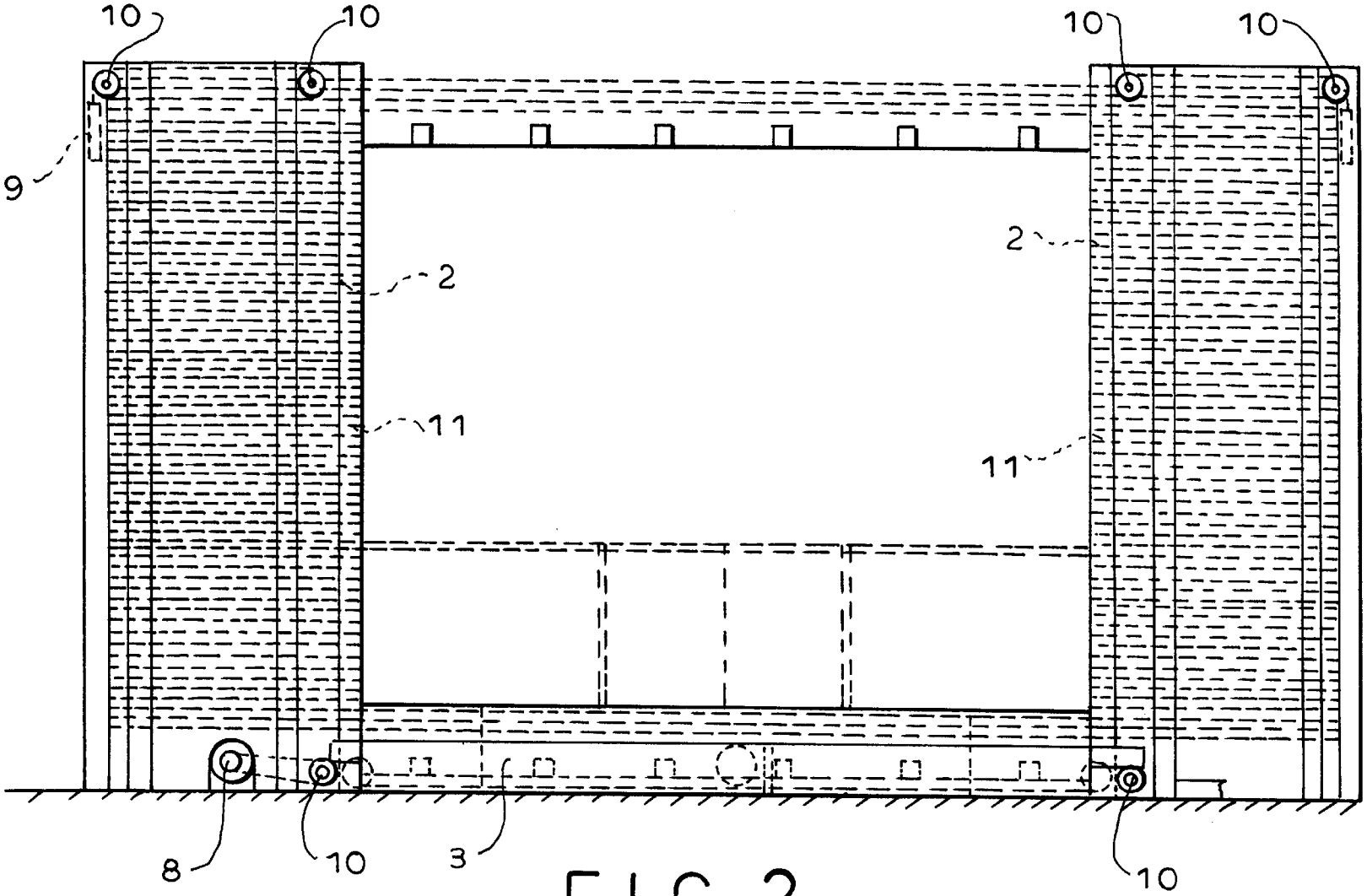
FIG. 2 is a front view of the presentation means of FIG. 1 with partly removed coverings.

FIG. 2 shows the presentation means 1 represented in FIG. 1 in the front view. One recognizes the two high stands 2 between which the upwardly and downwardly movable platform 3 is located. The platform 3 is suspended at the stands. This suspension system is discussed in detail in connection with FIG. 8 later on. The suspension system has two counter weights 9 whereby less energy is required for the lifting of the platform. An electric motor 8 drives a pulley 10 which is connected to further pulleys 10 at the upper ends of the stands by means of toothed belts.

FIGS. 3 and 4 show the structure of the stands 2 in detail. Corner profiles 15 on which roller tracks 14 are arranged are mounted at the side walls of the stands one above the other in a spaced condition. Rollers 13 which are rotatably mounted in the end portions of supporting plates 11 below the same run in these roller tracks. The product 12 which is to be presented is situated on each supporting plate 11. Obviously, the supporting plates 11 with the products 12 arranged thereon are thus horizontally movably mounted in the stands 2 and can be drawn from the respective compartment of the stand in the direction to the platform and moved back into the same.

Figure 5:
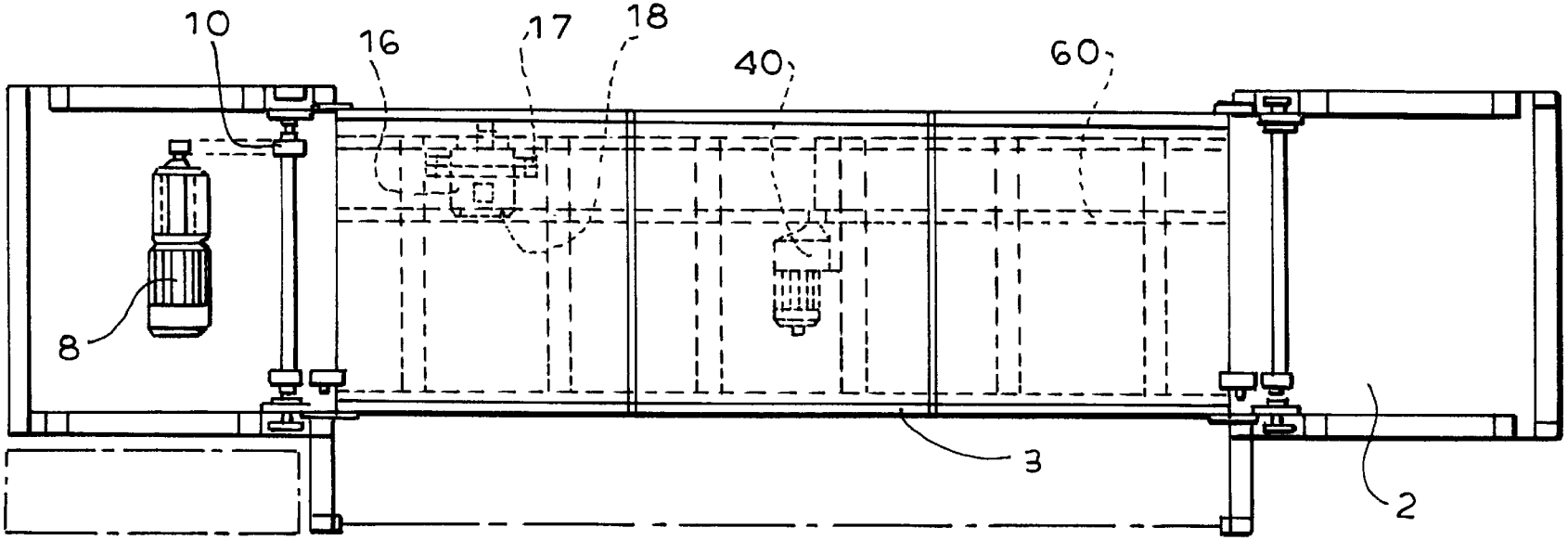
FIG. 5 is a top view of the presentation means with partly removed coverings.

FIG. 5 shows stands and platform in a top view with removed coverings. The rectangular platform 3 has an upper storing surface for the supporting plates 11 removed from the respective compartments of the stands. Furthermore, the platform includes roller tracks in its lateral portions which correspond to the roller tracks 14 of the stands for the storage of the supporting plates. Accordingly, in a corresponding position of the platform 3 the supporting plates can be thus moved out from the stands by means of the roller tracks 14 and through the corresponding roller tracks of the platform onto the same into a position of presentation.

The supporting plates 11 are drawn by means of a catching and moving means which is disposed within the platform 3. This means is formed by two carriages 16 which are movably mounted within the platform by means of rollers 18 on rails. In FIG. 5 a carriage 16 with corresponding moving track is shown. The second carriage moves parallel with respect to the carriage 16 on a carriage track in the other edge portion of the platform 3. A carriage drive means is located between the two movement tracks of the carriage. The motor of the carriage drive means is shown in FIG. 5 at 40.

Figure 6:
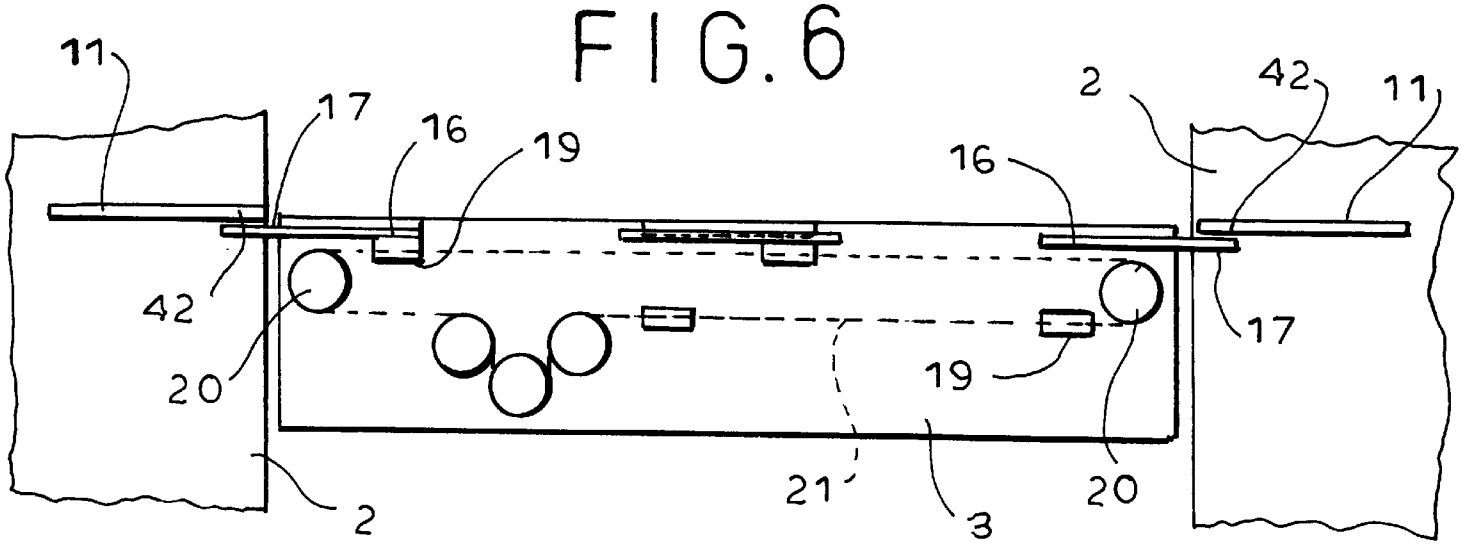
FIG. 6 is a schematic side view of the platform.
Figure 7:
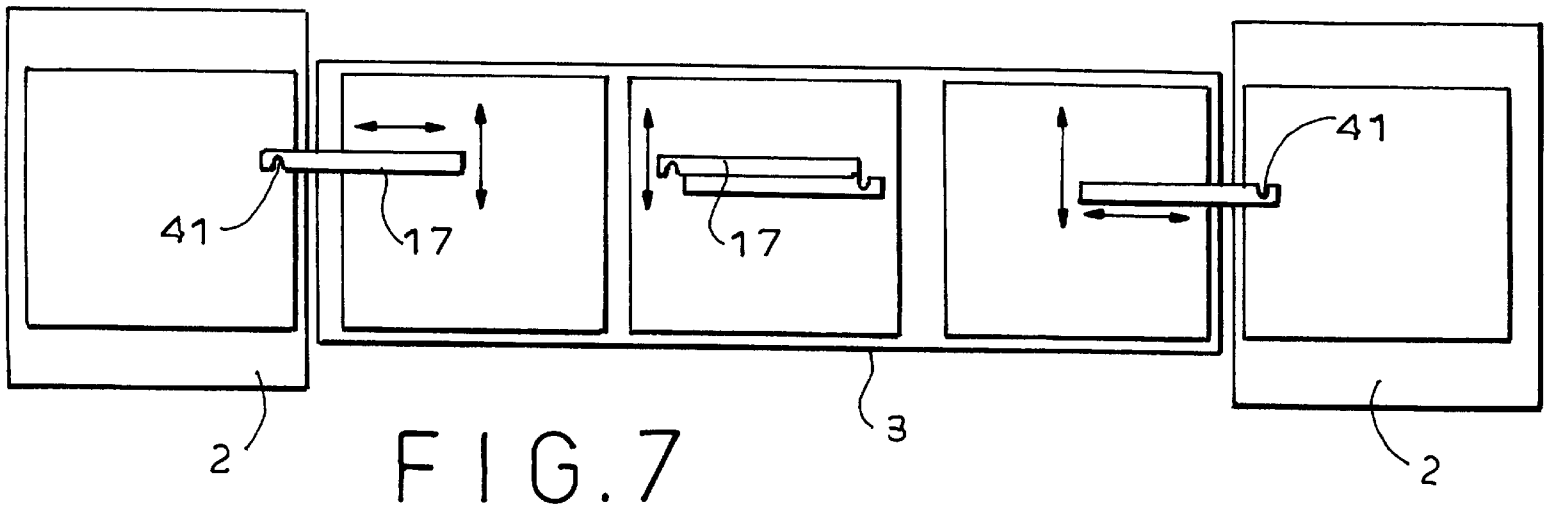
FIG. 7 is a schematic top view of the platform.
Figure 8:
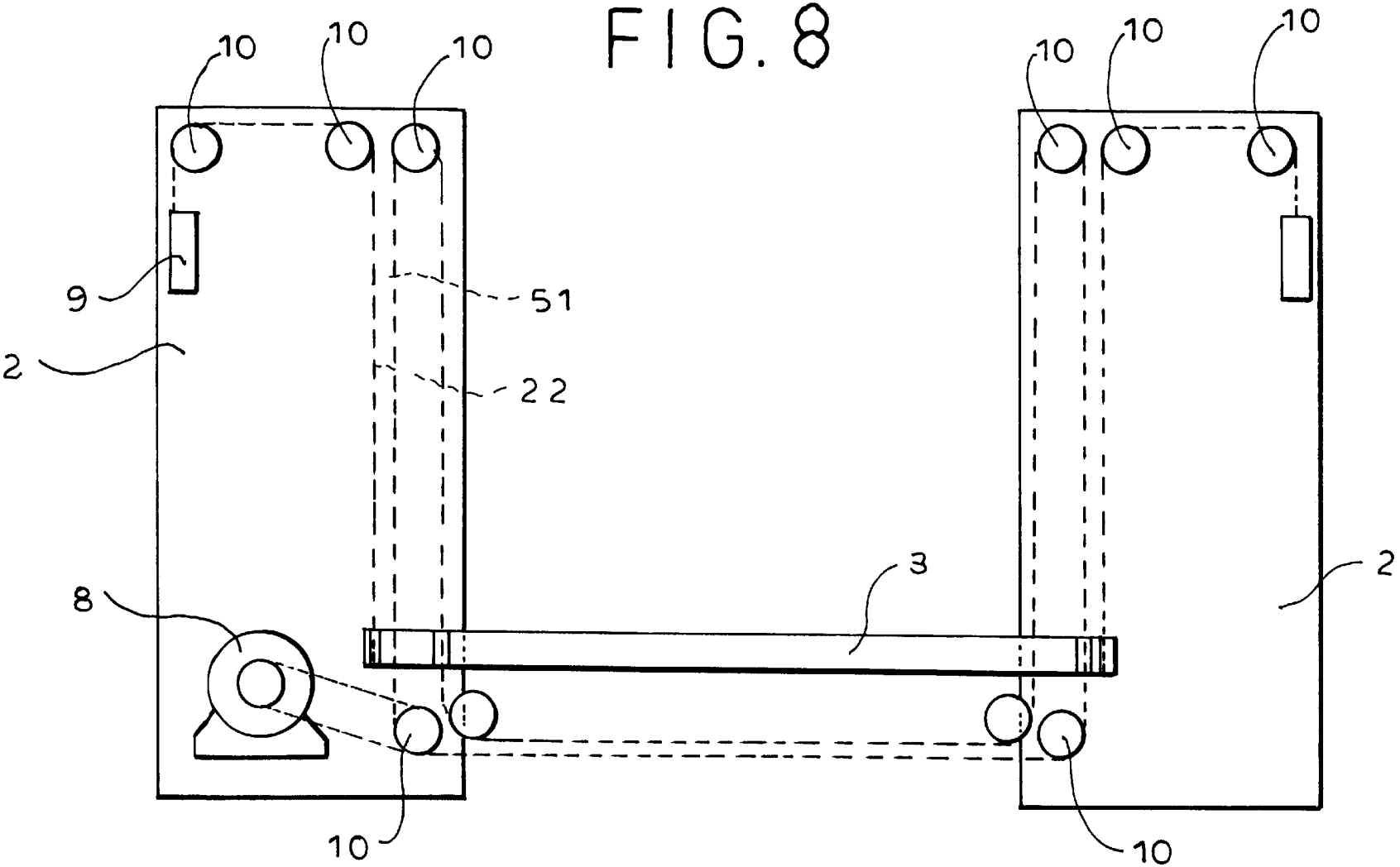
FIG. 8 is a schematic representation for the suspending system of the platform.

FIGS. 6 and 7 show schematically or diagrammatically the platform in a vertical section and in a top view. In reality the platform 3 extends into the column as shown in FIGS. 5 and 8. The carriage drive is a toothed belt drive 21 which extends around two pulleys 20. The two carriages 16 are fixed to the toothed belt 21 by means of clamping discs 19. One carriage 16 is fixed at the upper portion of the toothed belt by means of a clamping disc 19 while the other carriage is fixed at the lower portion of the toothed belt by means of a clamping disc 19. That means that two carriages 16 are moved into opposite directions when the belt drive is moved.

A catch 17 having in its front portion a recess 41 is disposed at each carriage 16. For catching a supporting plate 11 the catch 17 grips around with its recess 41 a bolt 42 disposed at the supporting plate 11 and thus can move the corresponding supporting plate into the central position of presentation on the platform. In order to make it possible that the catch 17 can grip around the bolt 42 it can carry out a slight lateral stroke as shown in FIG. 7. This stroke is realized by means of an actuating cylinder (not shown).

Accordingly, in the left position shown in FIG. 6 the bolt 42 of the supporting plate 11 is gripped around by the recess 41 of the catch 17, Through a movement of the belt drive to the right in FIG. 6 the supporting plate 11 is moved into the central position of the platform and can thus be presented there. Since both carriage tracks are arranged parallel with respect to one another the two carriages are not influenced in a disturbing manner.

FIG. 8 shows the suspension system for the platform 3. The platform 3 is fixed to a toothed belt 22 in its both outer end portions, respectively. The toothed belt extends over two pulleys 10 in the upper end portion of the stands 2 and has a counter weight 9 fixed at its end. A drive motor 8 drives a pulley 10 disposed in the lower range of the stand 2 by means of a toothed belt. Another toothed belt 51 extends around the pulley 10 and around another pulley 10 at the upper end of the stand. The platform 3 is also fastened at the toothed belt 51. Accordingly, by rotation of the lower pulley 10 the platform 3 is lifted or lowered wherein the counter weight 9 reduces the energy necessary for lifting. The transmission of force from the lower pulley 10 in the left stand 2 to the lower pulley 10 in the right stand is also realized by means of a toothed belt.

Figure 9:
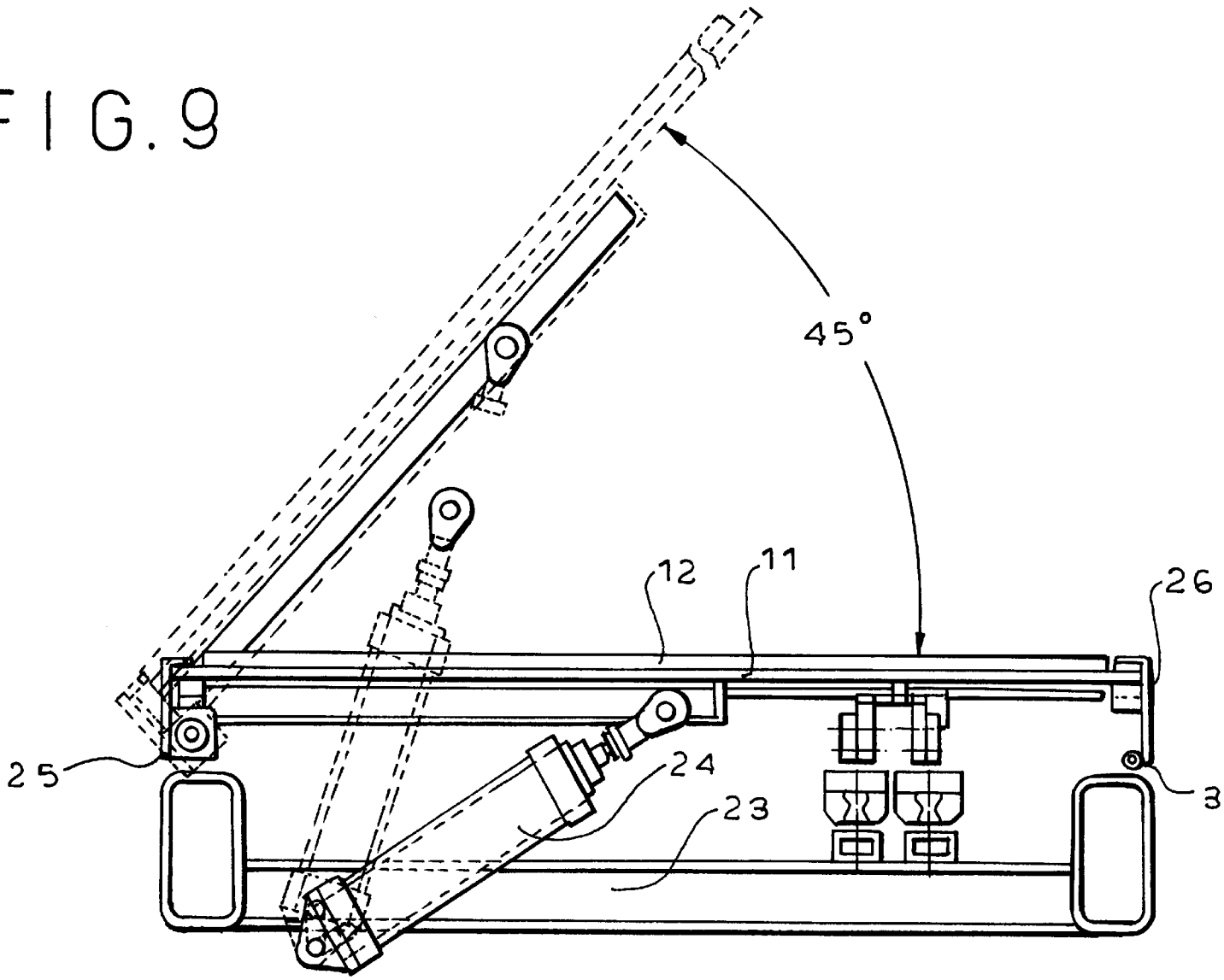
FIG. 9 is a cross-section through the platform.

FIG. 9 shows a cross section through the platform 3., This has a suitable underframe 23 as well as a cover plate structure. The cover plate structure includes in its end portions the roller tracks 26 in which the rollers of the several supporting plates 11 with products located thereon can run. The corresponding carriages for moving the supporting plates 11 with drive means are shown in the right part of the platform of FIG. 9.

As further shown in FIG. 9, the platform has at least one actuating cylinder 24 by means of which the cover plate structure can be pivoted about an axis 25 relative to the underframe. In FIG. 9 the position pivoted about 45 degree is shown. In this position the respective selected product can be presented in an inclined position.

The presentation means operates in the following manner:

If a customer wishes to see a certain floor tile which, for instance, is described in a brochure or is shown at monitor 6 he inputs, for instance, a code number corresponding to this tile into the control means through the keyboard 7. By this, the motor 8 for the platform is set in operation which moves the platform from the position shown in FIG. 1 upwardly until it reaches a position in which the platform is opposite to the supporting plate 11 carrying the desired product. Next, the motor 40 for the carriage drive is operated wherein the carriage 16 with catch 17 is moved in its open position into the catch position shown on the left side of FIG. 6. The actuating cylinder which is not shown draws the catch 17 into the engaging position in which the bolt 42 of the supporting plate 11 is gripped around by the recess 41 of the catch. Thereafter, the carriage 16 is moved to the right in FIG. 6 into the position of presentation. Hereafter, another operation of the platform drive follows so that the platform is moved again downwardly until it reaches the lower position shown in FIG. 1. If the customer wishes this, the inclined position of the platform shown in FIG. 9 can be adjusted by means of another command.

If the customer wishes to see a new product he inputs the new code number. The old product is laid down into the corresponding compartment of the stand whereafter the new product is brought into the position of presentation.

Another embodiment of the invention is characterized that the means moves the supporting plate with downwardly directed product into a position of presentation at the underside of the platform. According to this embodiment, for instance, ceiling elements are to be shown which the customer wishes to observe from below. The presentation means operates in the same manner as the above-described embodiment only with the difference that hereby the product is arranged in such a manner at the supporting plate that it can be observed from below and that the supporting plate is moved into a position at the underside of the platform. Accordingly, by lifting the platform the customer can look at the product from below so that, for instance, the impression of a part of a room ceiling results.

For instance, that product can be also a ceiling element with integrated ceiling light. The invention provides with such an embodiment that, when moving such a product with the platform into the position of presentation (ceiling position), the integrated ceiling light is switched on automatically. This can be realized, for instance, by means of triggering contact loops.

It is clear that the above-described underframe of the plate has to be omitted in the last described embodiment and can be arranged, for instance, as upper frame of the plate.

According to another embodiment the supporting plates are formed as drawers which can be open above or can have a glass covering. Preferably, in these drawers smaller products can be presented, as for instance jewelry. The drawers can have a suitable lighting.

What is claimed is:

1. A display for flat objects including floor tiles and ceiling tiles, said display comprising:

a rectangular platform having a pair of ends;

a respective column at each of said ends formed with means supporting said platform for travel vertically between said columns upwardly and downwardly, each of said columns being formed with a plurality of superposed plates in tiers each adapted to carry one of said objects and mounted for extension from the respective column onto the platform and recession from the platform into the respective column;

at least one carriage horizontally displaceable on said platform and formed with catch means for engaging and disengaging selected plates whereby, upon alignment with a plate on one of said columns, said carriage and said catch means draw a selected plate from a respective tier of said one of said columns onto said platform for display of a respective object on said platform and return a plate on said platform to a respective tier of the column;

a wall bridging said columns and formed with an image area displaying information relative to said objects;

controllable lighting means above said platform for directing lighting onto one of said objects displayed thereon whereby the lighting means represents a variety of lighting conditions; and control means connected to said image area, said platform and said carriage for operating same to display selected objects on said platform under selected lighting conditions, said platform comprising an underframe, a track on said underframe along which said carriage is displaceable between said columns, a cover on said underframe carrying said track means for pivotally mounting said cover to said underframe along one longitudinal edge of said cover, and an actuating cylinder between said cover and said underframe for pivoting said cover relative to said underframe.

2. The display defined in claim 1, further comprising a belt drive connected with said carriage for displacing same.

3. The display defined in claim 2, further comprising a pulley system with counter weights in said columns for supporting said platform and a motor drive connected with said pulley system for vertically displacing said platform.

* * * * *